United States Patent [19]

Jenkins

[11] Patent Number: 4,534,369

[45] Date of Patent: Aug. 13, 1985

[54] SMOKERS EQUIPMENT

[76] Inventor: Garry W. Jenkins, Cleveland, Ohio

[21] Appl. No.: 641,212

[22] Filed: Aug. 16, 1984

Related U.S. Application Data

[63] Continuation-in-part of Ser. No. 517,804, Jul. 27, 1983, abandoned.

[51] Int. Cl.[3] ..... A24F 17/00; A24F 19/02

[52] U.S. Cl. ..... 131/235.1; 131/238

[58] Field of Search ..... 131/329, 231, 238, 235 R, 131/242, 240 R, 241; 206/256–257, 259, 264, 265, 236, 237; 220/23, 1 H

[56] References Cited

U.S. PATENT DOCUMENTS

| | | | |
|---|---|---|---|
| 1,184,881 | 5/1916 | Schumacher | 131/238 |
| 1,447,623 | 3/1923 | Maliha | 131/238 |
| 1,737,644 | 12/1929 | Conner | 131/238 |
| 1,902,028 | 3/1933 | Hegwood | 131/242 |
| 2,124,481 | 7/1938 | Anderson | 131/242 |
| 2,265,336 | 12/1941 | Banck | 220/23 |
| 2,636,632 | 4/1953 | Miller | 220/1 H |
| 2,989,174 | 6/1961 | Wurman | 206/256 |

FOREIGN PATENT DOCUMENTS

| | | | |
|---|---|---|---|
| 0435745 | 9/1935 | United Kingdom | 131/242 |

*Primary Examiner*—V. Millin
*Assistant Examiner*—H. Macey

[57] ABSTRACT

Smoker's equipment for facilitating roll-your-own cigarettes includes a base formed from an open top box-like receptacle and a cover formed with a dished upper surface to serve as an ash tray. The cover fits down over the base to form a humidor. A ledge member located within the base supports a tray within the base, which tray separates the base into a first and second compartment. Tabs located within the base support a package of cigarette papers therein and permit the dispensing of the individual papers.

4 Claims, 4 Drawing Figures

SMOKERS EQUIPMENT

This application is a continuation-in-part of application Ser. No. 517,804 filed July 27, 1983, now abandoned.

This invention relates to smoker's equipment and particularly to a table article which will permit the storage of tobacco and cigarette paper and provide an ash tray for the convenience of cigarette smokers. The invention is a unitary article which serves as a tobacco humidor for keeping the cigarette tobacco moist, provides several compartments for storing different tobaccos, supports the cigarette papers in a manner which facilitates dispensing and includes an ash tray for snuffed-out cigarettes and ashes.

More and more persons are making "roll-your-own" cigarettes because of the high cost of factory made and packaged cigarettes. The increasingly high cost of commercially made cigarettes is due largely because legislators consider them to be a non-necessary, luxury item which can be highly taxed without putting too much of a financial strain on the general population.

To offset the high cost of ready made cigarettes, an increasing number of cigarette smokers are resorting to their own hand made cigarettes. This requires the nuisance of keeping the loose tobacco and the cigarette paper together as otherwise a search has to be made for one or the other or both each time a cigarette is desired. Further, the haphazard storage of tobacco will usually result in the creation of a mess as individual tobacco particles exit the tobacco bag or pouch.

Another problem associated with the loose tobacco used for making the roll-your-own cigarettes is that it has a tendency to dry out before it is all used up. This is because the bag or pouch that it comes in has no effective and foolproof way for resealing it after each withdrawal of tobacco.

Accordingly, it is an object of the present invention to provide smoker's equipment which maintains the paper and the tobacco or tobaccos together in a common table article and provides individual compartments for different tobaccos or other articles.

Another object of the present invention is to provide smoker's equipment which supports cigarette papers in a manner which facilitates dispensing.

Still another object of the present invention is to provide smoker's equipment which includes an ash tray for snuffed out cigarettes and ashes.

A further object of the present invention is to provide smoker's equipment which provides a humidor-like chamber or receptacle for the tobacco which keeps the tobacco fresh and smokeable for long periods of time.

A still further object of the present invention is to provide smoker's equipment which is relatively inexpensive to manufacture such that it can be sold at a low price.

An additional object of the present invention is to provide smoker's equipment which can be made out of heat resistant plastic which can be pressure molded or case into molds at high speed.

In accordance with the present invention, the smoker's equipment of the present invention includes a base formed from an open top box-like receptacle and a cover, formed with a dished upper surface to serve as an ash tray. The cover fits down over the base to form a humidifier. A ledge member, located within the base, supports a tray within the base which separates the base into a first and second compartment. Means located within the base support a package of cigarette papers therein and permit the dispensing of the individual papers.

In the accompanying drawings, to which reference is made in the instant specification and in which like reference characters are used to indicate like parts in the various views.

Figure 1:
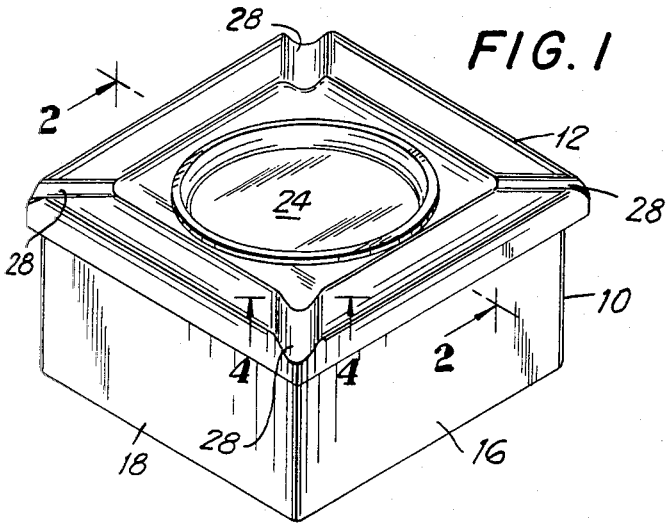
FIG. 1 is a perspective view of the smoker's equipment of the present invention.
Figure 4:
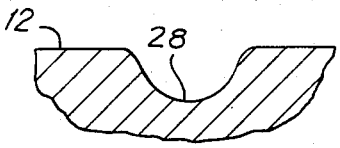
FIG. 4 is a partial view of the ash tray cover of the smoker's equipment taken along the line 4—4 of FIG. 1.
Figure 2:
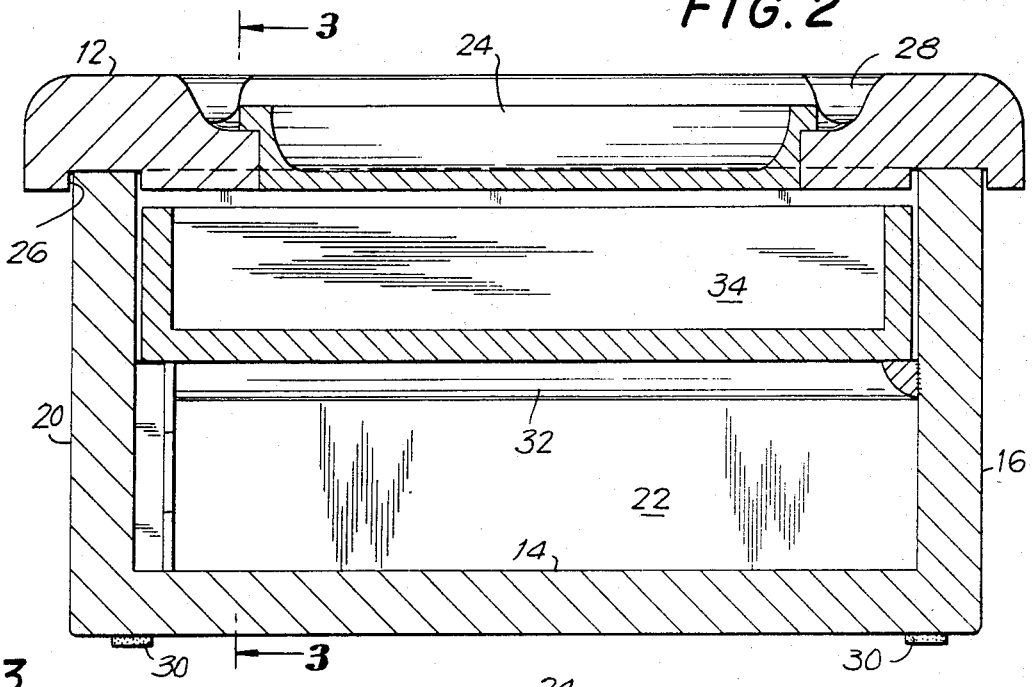
FIG. 2 is an elevational sectional view of the smoker's equipment taken along the line 2—2 of FIG. 1.
Figure 3:
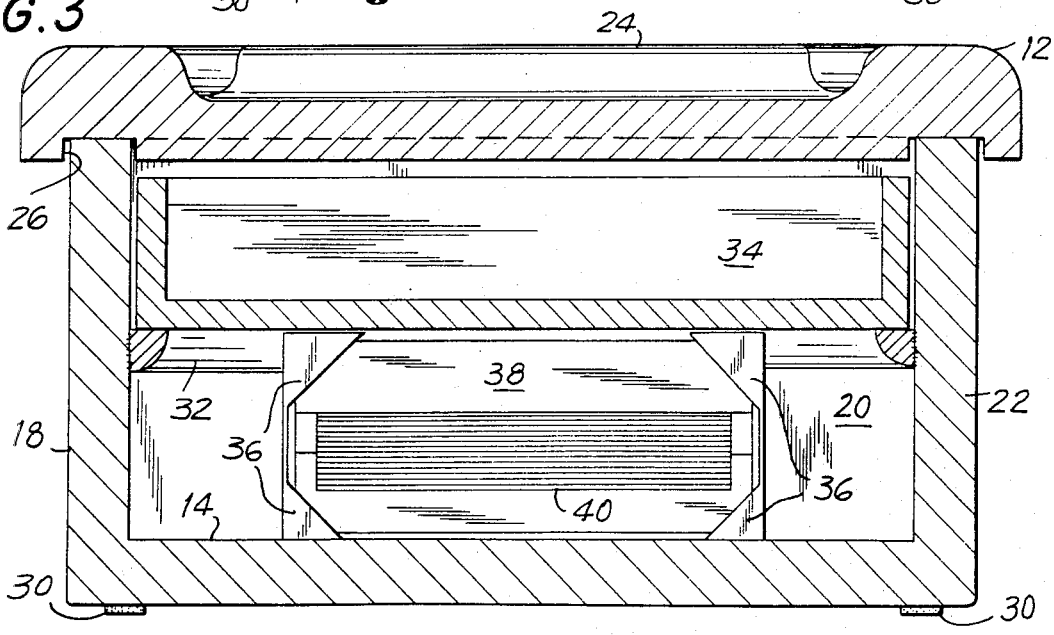
FIG. 3 is an elevational sectional view of the smoker's equipment taken along the line 3—3 of FIG. 2, and including a package of cigarette papers.

Referring now to FIGS. 1–4, the smoker's equipment includes two parts, the base receptacle or container 10 and the cover 12, which also serves as an ash tray. The base 10 is an open top box-like receptacle having a bottom wall 14, and side walls 16, 18, 20 and 22. The base 10 and cover 12 may be formed from any suitable material, such as heat resistant plastic which can be pressure molded or cast into molds at high speed. Alternatively, and as shown in the drawings, the base 10 and cover 12 could be formed from wood and the cover 12 could be formed to include a heat resistant concave center portion 24 formed, for example, or ceramic or stainless steel material, for receiving the ignited ends of cigarettes. If the cover 12 is made of heat resistant plastic it should still include a concave center portion 24 which may be either integrally formed or formed of the materials mentioned above. On the other side of the cover 12 is a depending flange 26 which extends around its edge and serves to fit the cover 12 snugly onto the top of the base 10. FIGS. 2 and 3 show this close fit against the tops of side walls 16, 18, 20 and 22, which provides a sealing effect to assure that the smoker's equipment acts as a humidor to keep fresh the tobacco contained therein.

To better serve as an ash tray, conventional grooves 28 are formed in the top surface of the cover 12 to receive cigarettes. The cover 12 should be thick enough to permit the formation of the grooves 28 and there may be more or fewer of them than the four shown.

The bottom wall 14 of the base 10 maybe flat so as to rest on a table top, and the under surface of the bottom wall 14 may be padded. Alternatively, the under surface of bottom wall 14 may be formed with a plurality of feet 30 which contact the table top.

Protruding from the internal surfaces of the side walls 16, 18, 20 and 22 of the base 10 is a quarter-round or ledge member 32 which extends almost completely around the internal perimeter of the base 10. Ledge member 32 may be secured to the side walls 16, 18, 20 and 22 as a one-piece unit or as separate pieces by any suitable means, such as gluing. Alternatively, ledge member 32 may be formed as part of the base 10. Ledge member 32 serves to divide the base 10 into two separate compartments by supporting a box-like tray 34 therein. Tray 34 is formed so that its bottom wall is supported on the ledge member 32 and its sidewalls are closely spaced to the side walls 16, 18, 20 and 22 of the base 10.

Tray 34 provides a first or upper compartment in the smoker's equipment, and a second or lower compartment is defined by the internal portion of the base 10 located below tray 34. The two compartments may be used to store different kinds of tobacco, or to separate matches or other smoking articles from tobacco, etc.

As best seen in FIGS. 2 and 3, the ledge member 32 does not extend completely around the internal perimeter of the base, but forms a gap extending across side wall 20. Located within the gap created by the ledge member 32 and extending from bottom wall 14 and adjacent to side wall 20 are four triangular shaped fingers or tabs 36 which engage the four corners of a package of cigarette papers 38 so as to retain the package within the lower compartment of the base 10, while permitting individual cigarette papers 40 to be removed from the package 38. The package 40 is placed behind the four tabs 36 by removing the cover 12 first and then the receptacle 34. The package may then be placed against wall 20 and moved donwardly behind the tabs 36 such that each corner of the package 40 is behind a tab 36. Cigarette papers 40 may be readily withdrawn from the package which remains stationary against wall 20. Tabs 36 may be formed as part of the base 10, or may be secured to sidewall 20 by any suitable means, such as gluing. It will be readily appreciated that any sort of arrangement, i.e., clamps, hooks or self-coiling tension springs, may be used to secure the package 38 within the base 10 while permitting the withdrawal of individual papers 38.

The smoker's equipment of the present invention assures that the tobaccos, cigarette papers, ash tray and other smoking articles are always together as a unified article for the smoker to use. The paper cannot become displaced from the tobaccos and may be readily dispensed and this encourages the use of the equipment to make cheaper cigarettes. It is very easy to add more tobacco or a new package of cigarette papers. Further, different tobaccos or other smoking articles may be placed in different compartments.

As will be readily apparent to those skilled in the art, the invention may be used in other specific forms or for other purposes without departing from its spirit or central characteristics. The present embodiments are therefore to be considered as illustrative and not restrictive, the scope of the invention being indicated by the claims rather than by the foregoing description, and all embodiments which come within the range of the equivalence of the claims are intended to be embraced.

I claim:

1. Smoker's equipment comprising a base formed from an open top box-like receptacle, a cover adapted to enclose the open top of said base, said cover and base forming a tobacco humidor, said cover further having a dished upper surface to serve as an ash tray, said base member comprising a bottom wall and side walls extending upwardly therefrom, an article supporting tray, a ledge member located within and secured to said base so as to support said article supporting tray within said base and separate said base into a first upper compartment containing said article supporting tray and a second lower compartment located beneath said article supporting tray, said ledge member has first and second ends and extends almost completely around the internal perimeter of the side walls, thereby defining a single gap between said ends at one of said side walls, said ledge member being substantially and uniformly spaced from the bottom wall, a cigarette paper package support means upwardly extending from the bottom wall into the gap between the ends of said ledge member, said support means comprising a plurality of tabs at the periphery thereof defining a cigarette paper package retaining means, said tabs formed and arranged so as to engage and hold the corners of a package of cigarette papers, thereby supporting said package of cigarette papers within said base while permitting the dispensing of individual cigarette papers.

2. Smoker's equipment as in claim 1 in which the upper surface of said cover is formed with cigarette receiving grooves.

3. Smoker's equipment as in claim 1 in which said base, said ledge member and said tabs are of unitary construction.

4. Smoker's equipment as in claim 1 in which said cover is of unitary construction.

* * * * *